US010280740B2

(12) United States Patent
Adam

(10) Patent No.: US 10,280,740 B2
(45) Date of Patent: May 7, 2019

(54) SANDFACE LINER WITH POWER, CONTROL AND COMMUNICATION LINK VIA A TIE BACK STRING

(71) Applicant: Mark K. Adam, Houston, TX (US)

(72) Inventor: Mark K. Adam, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 14/559,662

(22) Filed: Dec. 3, 2014

(65) Prior Publication Data

US 2016/0160638 A1 Jun. 9, 2016

(51) Int. Cl.
*E21B 47/12* (2012.01)
*E21B 43/08* (2006.01)

(52) U.S. Cl.
CPC ..... *E21B 47/122* (2013.01); *E21B 43/08* (2013.01); *E21B 47/123* (2013.01)

(58) Field of Classification Search
CPC ..... E21B 47/132; E21B 47/06; E21B 47/065; E21B 33/124; E21B 43/08; E21B 43/14; E21B 43/16; E21B 19/008
USPC ..... 166/360
See application file for complete search history.

(56) References Cited

U.S. PATENT DOCUMENTS 6,123,561 A * 9/2000 Turner ..... E21B 17/028 439/194
2008/0257544 A1* 10/2008 Thigpen ..... E21B 47/10 166/250.01
2009/0289808 A1* 11/2009 Prammer ..... E21B 17/003 340/853.7
2013/0133883 A1* 5/2013 Hill, Jr. ..... E21B 33/10 166/250.17

* cited by examiner

*Primary Examiner* — Matthew R Buck
*Assistant Examiner* — Patrick F Lambe
(74) *Attorney, Agent, or Firm* — Cantor Colburn LLP

(57) ABSTRACT

In one aspect, a method of completing a wellbore is disclosed that in one non-limiting embodiment includes: placing a completion assembly in the wellbore, the completion assembly including a first link along an outside the completion; placing a second link between a surface location and a subsea location; placing a string having a third link between the first link and the second link; and connecting the third link to the first link and the second link to provide a continuous link between the completion assembly and the surface location.

19 Claims, 3 Drawing Sheets

SANDFACE LINER WITH POWER, CONTROL AND COMMUNICATION LINK VIA A TIE BACK STRING

BACKGROUND

1. Field of the Disclosure

This disclosure relates generally to real-time monitoring and control of downhole operations via two-way communication links.

2. Background of the Art

Wellbores are drilled for the production of hydrocarbons (oil and gas) from traps or zones in subsurface formations at different wellbore depths. Such zones are also referred to as reservoirs or hydrocarbon-bearing formations or production zones. Wellbores often are formed through several spaced-apart zones. A completion assembly containing equipment corresponding to each zone is placed in the wellbore. Completion assemblies include a variety of devices, such as packers to isolate the zones, sand screens to mitigate flow of solid particles from the formation to the wellbore, flow control devices for supplying treatment fluids to the zones, valves to facilitate fluid flows during installation of completion assembly, treatment operations and production of hydrocarbons, etc. Lines or links, such as electrical lines and fiber optic lines, are sometimes placed along the completion assembly for data communication and control of downhole equipment. In subsea applications links are run along a riser from the surface to wellhead equipment at the seabed. The completion assembly may include a link along its side. The completion assembly is generally hung on already installed casings several hundred feet below the seabed. It is desirable to provide apparatus and methods to install links between the links in the completion assembly and the risers.

The disclosure herein provides apparatus and methods for providing continuous links between downhole locations and the surface in subsea wellbores.

SUMMARY

In one aspect, a method of completing a wellbore is disclosed that in one non-limiting embodiment includes: placing a completion assembly in the wellbore, the completion assembly including a first link along an outside the completion; placing a second link between a surface location and a subsea location; placing a string having a third link between the first link and the second link; and connecting the third link to the first link and the second link to provide a continuous link between the completion assembly and the surface location.

In one aspect an apparatus for use in a wellbore is disclosed that in one non-limiting embodiment includes a completion assembly with a first link on an outside of the completion assembly for placement in the wellbore, a second link in a riser between a subsea equipment and a surface location and a connection tie-back string including a third link connected to the first link and the second link to provide a continuous connection from a location in the wellbore to the surface.

Examples of the more important features of the apparatus and methods disclosed herein are summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally represented by same numerals and wherein.

DETAILED DESCRIPTION OF THE DRAWINGS

Figure 1:
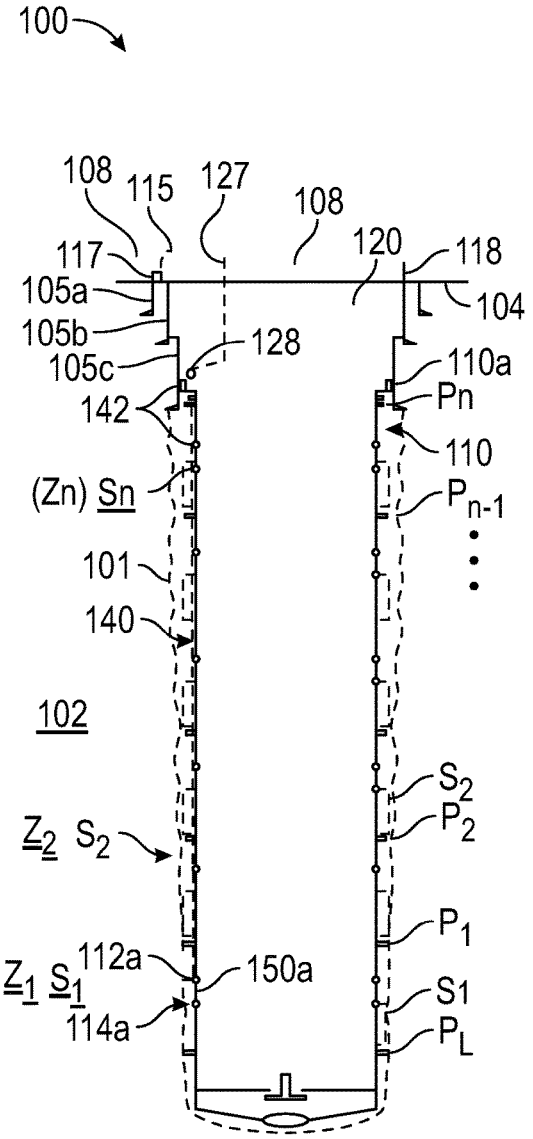
FIG. 1 shows a subsea wellbore system that includes a riser with a link from a subsea equipment to the surface and a multi-zone completion assembly, such as a sand face liner, having a second link along the completion assembly for placement or installation of the liner in the wellbore with a liner hanger running tool.

FIG. 1 shows a subsea wellbore system 100 that includes a subsea wellbore 101 formed in a formation 102 below the sea bed 104. Casings 105*a*, 105*b* and 105*c* successively line upper portions of the wellbore 101 to selected depths for stabilizing the subsurface below the seabed 104. A riser 118 is shown run from the seabed 104 to the surface 108. A link 115 along the riser 118 runs from the seabed equipment, such as blow-out preventers, etc. commonly utilized in the art, to the surface 108. The link 115 may be any suitable line, including, but not limited to, electrical conductors, optical fibers and wireless connections. The link 115 includes a lower connection 117, which may be a wet connect known in the art.

To place or deploy a completion assembly, such as a sand face liner 110, in the wellbore 101, the completion assembly 110 is run into the wellbore 101 with a liner hanger tool 120 attached to an upper end 110*a* of the completion assembly 110. In the particular embodiment of subsea system 100, the completion assembly 110 is a multi-zone sand face liner having screens or screen sections S1-Sn respectively associated with zones Z1-Zn and configured to perform a treatment operation of their associated production zones and for the production of formation fluids therefrom. In the non-limiting embodiment of FIG. 1, the sand face liner 110 includes a lower packer PI and isolation packers P1-Pn respectively corresponding to screens S1-Sn and thus zones Z1-Zn. Packer P1 when activated isolates zone Z1 corresponding to screen S1 from the remaining zones, packer P2 isolate zone Z2 when packers P1 and P2 are set and packer Pn isolates zone Zn when packers Pn-1 and Pn are set. In a non-limiting embodiment, each screen may contain a number of axially connected screens, a flow through device (also referred to as screen sleeve) and a frac sleeve. As an example, frac sleeve 112*a* is shown below packer P1 and screen S1 containing a screen sleeve 114*a* is shown below the frac sleeve 112*a*. Other screens also include similar frac sleeves and monitoring valves. Frac sleeves provide a flow path from inside the sand face liner 110 to the formation 102 for treatment fluid, such as slurry containing proppant or another fluid. Screen sleeve 114*a* provides flow path from the zone Z1 to the inside of the sand face liner 110. Frac sleeves and monitoring valves are known in the art and thus not described in detail herein. Any available frac sleeve and monitoring valve may be utilized for the apparatus and methods disclosed herein.

Still referring to FIG. 1, a link 140 is run along the outside of the sand face liner 110. The link 140 may be run inside a tubing attached to the outside of the sand face liner 110 and run through the packers P1-Pn or run in any other known manner. The link 140 includes an upper connection 142, which may be a wet connect know in the art. Sensors 150*a* placed in or along screen S1 provide measurements relating to one or more parameters of interest, including but not limited to, pressure, temperature, flow rate, vibration, corrosion and water content. Similar sensors are placed along other screens. After the liner 110 has been set against the liner 105*c*, the liner hanger running tool 120 is retrieved from the wellbore as shown FIG. 2 below.

Figure 2:
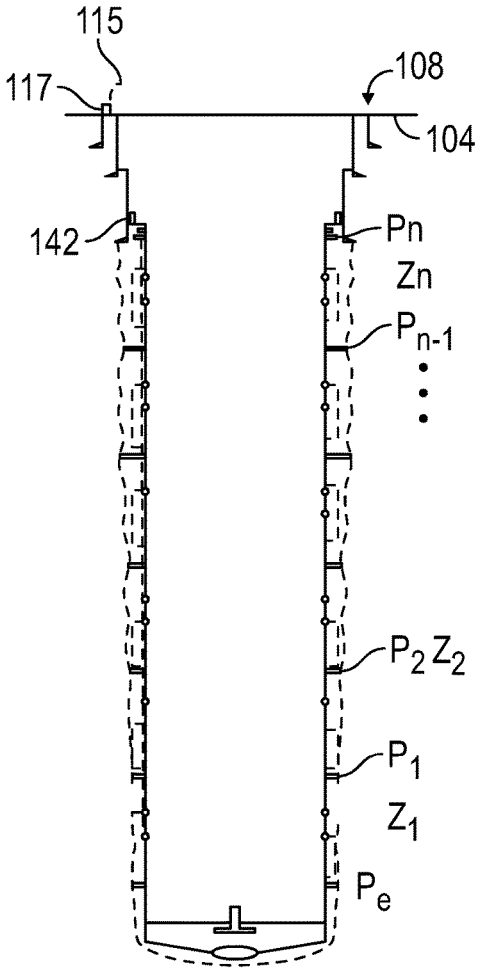
FIG. 2 shows the wellbore system of FIG. 1 after the placement of the completion assembly in the wellbore and the retrieval of the liner hanger running tool from the well bore.

FIG. 2 show the wellbore system of FIG. 1 with the liner hanger tool 120 retrieved from the wellbore 101. The lower packer PI and the isolation packers P1-Pn are set or activated. Any available packer may be utilized for the purposes of this disclosure, including, but not limited to, packers that may be set hydraulically, mechanically and electrically. FIG. 2 shows all packers PI and P1-Pn set against the wellbore 101, thereby isolating each of the zones Z1-Zn from the remaining zones. The running tool 120 may be retrieved after setting packers. At this stage, the lower connection 117 of the riser link 115 and the upper connection 142 of the sand face liner link 140 are exposed or open.

Figure 3:
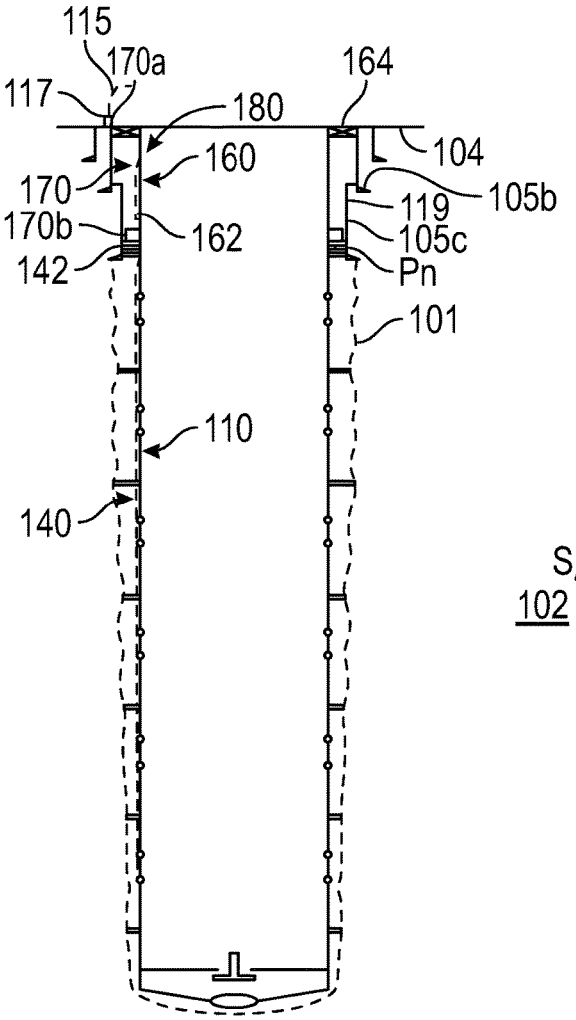
FIG. 3 shows the wellbore system of FIG. 2 with a tie-back string including a third link along the tie-back string for connecting the link along the completion assembly to link in the riser to provide a continuous connection.

Referring to FIG. 3, after retrieval of the liner hanger running tool 120 and the setting of the packers PI and P1-Pn, a tie-back string or member 160 is run into the wellbore 101 that provides a connection or link between the lower connection 117 of the riser link 115 and the upper connection 142 of the sand face liner link 140. The tie-back string 160 includes a pipe 162 and a link 170 along the outside of the pipe 162. The link 170 includes an upper connection 170*a* configured to sealingly connect to or mate with the lower connection 117 of the riser link 115 and a lower connection 170*b* configured to sealingly connect to or mate with the upper connection 142 of the sand face liner link 140. Any suitable available connection may be utilized, including wet connect and connection that may be stabbed, to provide such sealed connections. The tie-back string 160 also may include a packer 164 at an upper end thereof for sealing the annulus 119 between the tie-back string 160 and the liners 105*b* and 105*c*. The tie-back string 160 is run into the wellbore by a running tool (not shown) and upper connection 142 of the link 140 is connected with the lower end 170*b* of the link 170 while the lower end 117 of the riser link 115 is connected to the upper end 170*a* of link 170. These connections may be made by the running tool or any other method known in the art. The packer 164 is set to isolate the annulus 119. Links 115, 170 and 140, when connected serially as shown in FIG. 3, provide a continuous link between downhole sensors, such as sensors 150*a* shown in FIG. 1 and a controller at the surface as shown in FIG. 4.

Referring back to FIGS. 1 and 3, instead of running a tie-back string 160, a link 127 may be run along the liner hanger running tool 120 having a lower connection 128 configured to connect to or mate with the upper connection 142 of the sand face liner link 140. In such a case, the liner hanger running tool 120 may also be utilized to connect the link 127 to the link 140. The link 127 is detachable from the liner hanger running tool 120 once it has been connected to the link 140. Links 127 and 140 when connected to each other provide a continuous link between downhole sensors and device and the surface. The continuous link, whether combination of links 115, 140 and 170 or 140 and 127 is designated by numeral 188. Once the communication link 188 is installed as discussed in reference to FIGS. 1-3, various downhole operations may be performed using such link.

Figure 4:
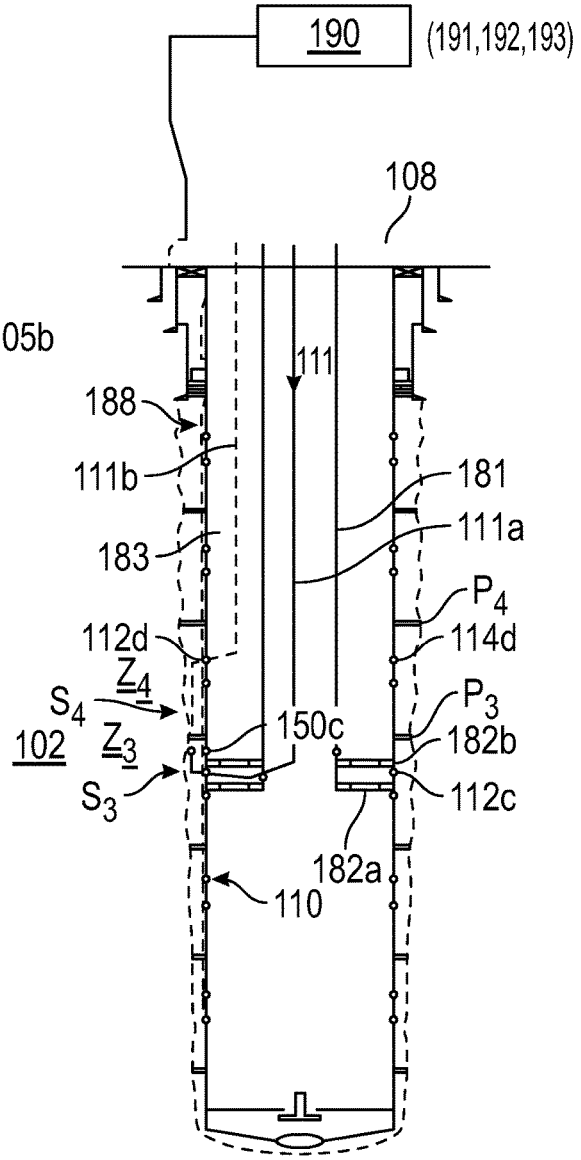
FIG. 4 shows the wellbore system of FIG. 3 for performing a pressure test of a selected zone using the continuous link shown in FIG. 3.

FIG. 4 shows an exemplary pressure test operation for zone Z3 utilizing the link 188 for explanation purposes only and not as any limitation. To pressure test zone Z3, frac sleeve 112*c* of screen S3 and frac sleeve 112*d* of frac screen S4 (the screen above screen S3) are opened while the packers P2 below packer P3 and packer P4 above packer P3 are set. A pipe 181 containing a lower seal 182*a* and an upper seal 182*b* proximate to its bottom end is run into the sand face liner 110. The pipe 180 is set so that seal 182*a* is below the frac sleeve 112*c* and seal 182*b* is above the frac sleeve 112*c*. Seals 182*a* and 182*b* are engaged so as to seal flow of fluid from the pipe 181 to the frac sleeve 112*c*. A fluid 111 under pressure is supplied to the pipe 181 and thus to the zone Z3. Fluid flow path from the surface to the zone Z3 is shown by solid line 111*a*. Sensors 150*c* provide measurement of various parameters of interest, including, but not limited to, pressure, temperature, flow rate and vibration to a surface controller 190 via link 188. The controller 190 may be a computer-based system that includes a processor 191, storage device 192 and programs 193 accessible to the processor 191 for executing instructions contained in programs 193. The pressure from the surface may be ramped over time. The sensor 150*c* provides pressure measurements in the zone Z3. If there is a leak in the isolation packer P3, fluid will flow into zone Z4 and return to the surface via open frac sleeve 112*d* and annulus 183 as shown by path 111*b* between the sand face liner 110 and the pipe 181. The sensor 150*c* also may provide flow rates. The pressure and flow rates may be utilized to determine the integrity of the packer P3 and fluid flow rate into zone Z3. Similar tests may be performed for other zones.

Figure 5:
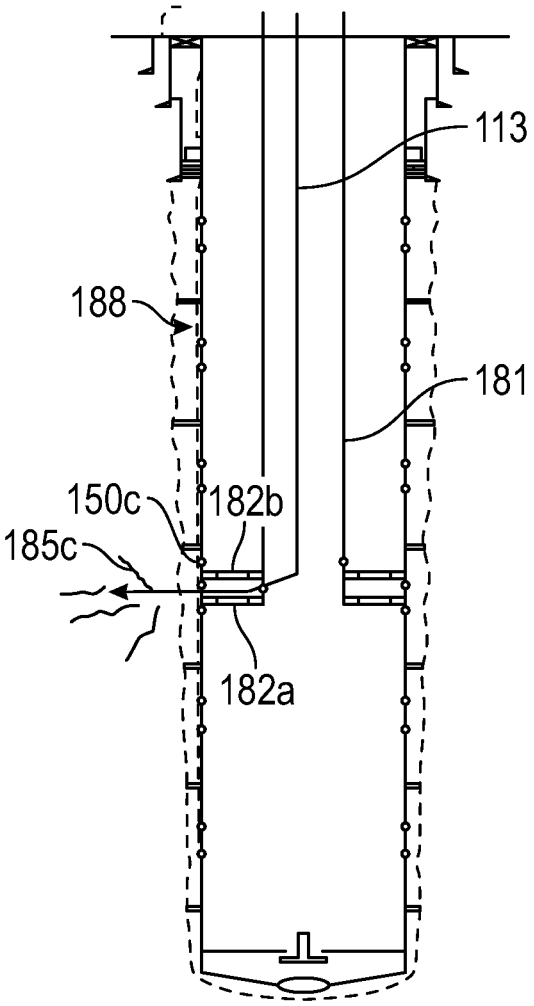
FIG. 5 shows the wellbore system of FIG. 4 for performing a treatment operation, such as fracturing, of the selected zone using the same downhole equipment as used for performing the pressure test shown in FIG. 4.

FIG. 5 shows an example of a treatment operation of zone Z3 utilizing sensors 150*c* and link 188. To perform a treatment operation, such a fracturing, slurry 113 containing a suitable proppant may be supplied to the pipe 181 for fracturing formation in zone Z3, as shown by fractures 185*c*. Sensors 150*c* provide real time measurements of parameters of interest to the controller 190 during the fracturing operation, including, but not limited to, pressure, temperature, flow rate, and vibration. Although FIG. 5 shows treatment of a single zone Z3, two or more contiguous zones may be treated by not isolating such zones from each other. In any downhole operation, the controller 190 and/or an operator may control any operation in response to the measurement form the sensors via link 188. The link 188 may contain any number of individual links to supply power to electrically-operated devices, such as valves, motors and sensors. The link 188 also is configured to provide real-time two-way data communication between downhole circuits that control downhole devices and process signals from the sensors. Although, the wellbore system 100 described herein includes an open hole, the apparatus and methods disclosed herein are equally applicable to cased holes, i.e., wellbores containing a casing lined inside the wellbore.

The foregoing disclosure is directed to certain exemplary embodiments and methods. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. A method of completing a wellbore, comprising:

placing a completion assembly having a first wired communication link that runs along an outside of the completion assembly in the wellbore, the completion assembly including a sand face liner with at least one sensor wherein the first wired communication link runs along the sand face liner to the sensor and has an upper connection at a top end of the completion assembly;

placing a riser extending from a seabed to a surface location, the riser including a second wired communication link extending from seabed equipment to the surface location, wherein the second communication wired link has a lower connection at a bottom end of the riser;

running a string including a pipe having a third wired communication link along the outside of the pipe into the wellbore via a running tool to a location between the completion assembly and the riser after placement of the completion assembly and the riser; and connecting a lower connection of the third wired communication link to the upper connection of the first wired communication link and an upper connection of the third wired communication link to the lower connection of the second communication wired link to provide a continuous wired communication link between the sensor of the completion assembly and the surface location.

2. The method of claim 1, further comprising securing the string to the completion assembly and the riser.

3. The method of claim 1, further comprising using the running tool to connect the third wired communication link to the first wired communication link and the second wired communication link.

4. The method of claim 1 further, wherein the completion assembly includes a plurality of screens in serial arrangement, each screen corresponding to a zone along the wellbore and having an associated isolation packer above the screen for isolating the zone corresponding to the screen from other zones, the method further comprising hanging the completion assembly from a casing in the wellbore by a liner hanger tool.

5. The method of claim 1 further comprising coupling the sensor along a selected screen of the completion assembly to the first wired communication link, the method further comprising:

isolating a zone associated with the selected screen; and performing a downhole operation relating to the zone associated with the selected screen; and determining a downhole parameter of interest relating to the downhole operation from measurements from the sensor.

6. The method of claim 5, wherein the completion assembly includes a flow path below an isolation packer associated with the selected screen and wherein the downhole operation comprises supplying a fluid under pressure to the zone associated with the selected screen.

7. The method of claim 6, wherein the downhole operation is selected from a group consisting of: a pressure test; and a treatment operation.

8. The method of claim 5, wherein the parameter of interest is selected from a group consisting of: pressure, temperature, flow rate, vibration, corrosion and water content.

9. The method of claim 1, wherein the continuous wired communication link comprises one of fiber optic and electrical line to transmit one of signals and power.

10. The method of claim 1, wherein the continuous wired communication link provides power to operate devices in the completion assembly and two-way communication of data between the devices and the surface location.

11. A wellbore system, comprising:

a completion assembly including a plurality of screens, each screen corresponding to an associated zone along the wellbore, the completion assembly including a sand face liner with at least one sensor and a first wired communication link running along the sand face liner to the sensor, the first wired communication link having an upper connection at a top end of the completion assembly;

a riser extending from a seabed to a surface location, the riser including a second wired communication link extending from a seabed equipment to the surface location, wherein the second wired communication link includes a lower connection at a bottom end of the riser;

a string between the completion assembly and the riser that seals an annulus between the string and a casing at an upper end of the wellbore, the string including a pipe having a third wired communication link along the outside of the pipe, the third wired communication link having a lower connection that connects to the upper connection of the first wired communication link and an upper connection that connects to the lower connection of the second wired communication link to provide a continuous wired communication link between the sensor of the completion assembly and the surface location; and a running tool for running the string to a location between the completion assembly and the riser.

12. The wellbore system of claim 11, wherein the connections between the first, second and third wired communication links are wet connects.

13. The wellbore system of claim 11, wherein the completion assembly further includes an isolation packer above each screen for isolating the screen's associated zone from other zones and a flow device below each isolation packer.

14. The wellbore system of claim 13, wherein the completion assembly includes a flow device below each isolation packer of each screen for supplying fluid from the surface to a zone associated with each such screen for treating each such zone.

15. The wellbore system of claim 14 further includes a screen sleeve in each screen that provides a flow path for fluids from a formation into the completion string.

16. The wellbore system of claim 11 further comprising a sensor associated with each screen and coupled to the first wired communication link for providing measurements relating to a parameter of interest relating a downhole operation.

17. The wellbore system of claim 16, wherein the parameter of interest is selected from a group consisting of: pressure, temperature, flow rate, vibration, corrosion and water content.

18. The wellbore system of claim 11, wherein the second wired communication link is placed along the riser from a sea bed wellhead equipment and the surface location.

19. The wellbore system of claim 11, wherein the continuous wired communication link is configured to supply power from the surface to a downhole device and data communication between sensors associated with the screens and a surface location.

* * * * *